US007673873B2

(12) United States Patent
Mindler et al.

(10) Patent No.: US 7,673,873 B2
(45) Date of Patent: Mar. 9, 2010

(54) OFFSET PRINT STACKING TRAY WITH ANTI-STUBBING FEATURE

(75) Inventors: Robert F. Mindler, Churchville, NY (US); Robert C. Cohoon, Spencerport, NY (US); Theodore J. Skomsky, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 1095 days.

(21) Appl. No.: 10/866,932

(22) Filed: Jun. 14, 2004

(65) Prior Publication Data

US 2005/0275157 A1 Dec. 15, 2005

(51) Int. Cl.
*B65H 31/00* (2006.01)

(52) U.S. Cl. ..... 271/209

(58) Field of Classification Search ..... 271/207, 271/209, 224

See application file for complete search history.

(56) References Cited

U.S. PATENT DOCUMENTS 3,319,768 A * 5/1967 Holzhauer et al. ..... 222/56
4,155,643 A * 5/1979 Ladds et al. ..... 355/72
4,340,285 A * 7/1982 Clarke ..... 396/544
4,353,542 A * 10/1982 Knight et al. ..... 271/294
4,364,553 A * 12/1982 Wilson ..... 271/219
4,746,233 A 5/1988 Garcia de Osuna et al.
5,061,098 A * 10/1991 Engelhardt et al. ..... 400/625
5,110,111 A * 5/1992 Gompertz et al. ..... 271/186
5,172,905 A * 12/1992 Vanous et al. ..... 271/209
5,188,353 A * 2/1993 Parks ..... 271/184
5,686,950 A * 11/1997 Hirakue ..... 347/104
6,065,747 A * 5/2000 Khovaylo et al. ..... 271/209
6,354,588 B1 * 3/2002 Kuwahara et al. ..... 271/224
6,464,449 B1 * 10/2002 Takeno ..... 414/791.2
D470,884 S 2/2003 Gotham et al.
6,572,102 B2 * 6/2003 Vedoy ..... 271/224
6,923,438 B2 * 8/2005 Matsuyama et al. ..... 271/207

* cited by examiner

*Primary Examiner*—Patrick H Mackey
*Assistant Examiner*—Gerald W McClain
(74) *Attorney, Agent, or Firm*—Mark G. Bocchetti

(57) ABSTRACT

A tray for receiving printed media from a printer, the tray including a print well, a ramp and at least two side walls. There is at least one support member extending from the tray adapted to engage the printer and position the tray such that the print well is laterally offset from the exit slot of the printer and prints exiting from the printer overhang one of the side walls of the tray. A ledge feature projects from the side wall that exiting prints overhang, the ledge feature configured to bias movement of the printed media exiting the printer and in contact the ledge feature to fall into the print well.

16 Claims, 11 Drawing Sheets

OFFSET PRINT STACKING TRAY WITH ANTI-STUBBING FEATURE

FIELD OF THE INVENTION

The present invention relates generally to print media stacking trays used in conjunction with printers such as to photographic thermal printers, and more particularly, to print stacking trays for reducing the potential of stubbing or jamming of finished printed sheets exiting from the printer into the print media stacking tray.

BACKGROUND OF THE INVENTION

Stubbing is a common problem in many printers; particularly printers that include horizontally oriented stacking trays. Stubbing occurs when after a first print has already been received in the stacking tray, a second print emerges from the exit slot of the printer and the lead end of the emerging print receives interference from the trailing end of the print already in the stacking tray. This type of interference occurs because the trailing end of the print in the receiving tray is proximate to the exit slot. This stubbing problem creates a potential jamming situation for the next print to exit the slot of the printer.

Stubbing can occur in a variety of printers including photographic thermal printers, inkjet printers, electro-photographic printers, and laser printers. Stubbing is probably most common in photographic thermal printers that have the capability of printing more than one size print, for example, 4×6 and 6×8 prints. While the problem of stubbing itself is not a very significant problem, as mentioned above, stubbing can lead to jamming and jamming is quite significant.

SUMMARY OF THE INVENTION

It is therefore a desired feature of a tray for receiving sheets of printed media emerging from an exit slot of a printer to avoid stubbing.

Briefly stated, the above stated feature, as well as other objects and advantages of the present invention will become readily apparent upon a reading of the detailed description and a review of the drawings herein. These features, objects and advantages are accomplished by providing a tray for receiving sheets of printed media emerging from an exit slot of a printer wherein the tray comprises a media entry zone, a print well including a ramp and at least two side walls, the ramp located below the media entry zone, and at least one support member extending from the tray adapted to engage the printer and position the tray such that the print well is laterally offset from the exit slot and prints exiting from the printer overhang the first side wall. In this manner, the prints emerging from the exit slot overhang the one side wall as they exit the exit slot of the printer. Depending on the angle of exit of the print from the printer and the angle of the tray as well as the flexibility of the print, at some point before the print is released from the exit slot, a portion of one side of the print may actually rest on one of the side walls. Once the print is fully released from the exit slot, the print will fall off the side wall into the print well and fall vertically down to the bottom of the print well. Thus, the offset of the tray ensures movement of the print down and laterally away from the exit slot to ensure that stubbing does not occur. There is no possibility that the lead end of the second print will fall into the print well to abut the trailing end of a print already in the print well. This is because the second print will be partially supported by the side wall until the lead end thereof already passes the trailing end of the print in the print well before it falls completely into the print well. This support may be enhanced by providing a ledge member projecting from one of the side walls wherein the ledge member is configured to bias movement of the printed media exiting the printer and in contact with the ledge member to fall into the print well.

DETAILED DESCRIPTION OF THE INVENTION

Figure 1:
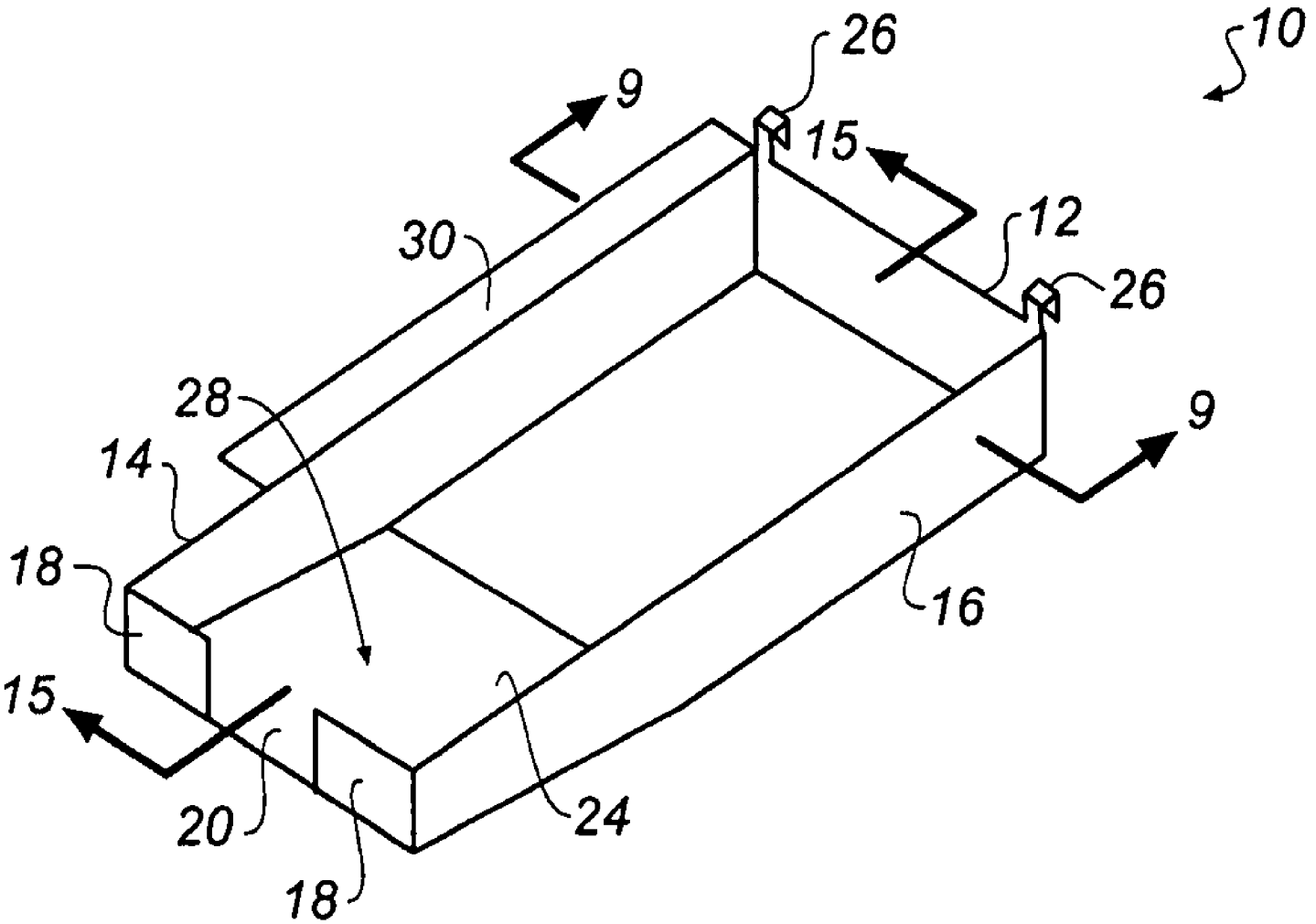
FIG. 1 shows a perspective view of the receiving tray of the present invention.

Turning first to FIG. 1, there is shown a perspective view of the preferred embodiment of the receiving tray 10 of the present invention. The receiving tray 10 includes a rear wall 12, a first side wall 14, a second sidewall 16 and a front wall 18. Front wall 18 may be provided with an access opening 20 to allow a user to easily grasp prints delivered to the exit tray from the printer. Extending between first side wall 14 and second side wall 16 are ramp portion 22 and base portion 24. Projecting from rear wall 12 are brackets 26 adapted to be engaged with a printer proximate to the exit slot of the printer as will be discussed hereinafter. Brackets 26 may be designed to partially or fully support receiving tray 10 from the printer. That portion of the receiving tray proximate to front wall 18 and base 24 may be considered the print well 28. It is to this region of the receiving tray 10 that prints emerging from the printer fall.

Projecting from first side wall 14 is ledge member 30. Ledge member 30 is preferably angled such that it slopes toward the interior of receiving tray 10.

Figure 2:
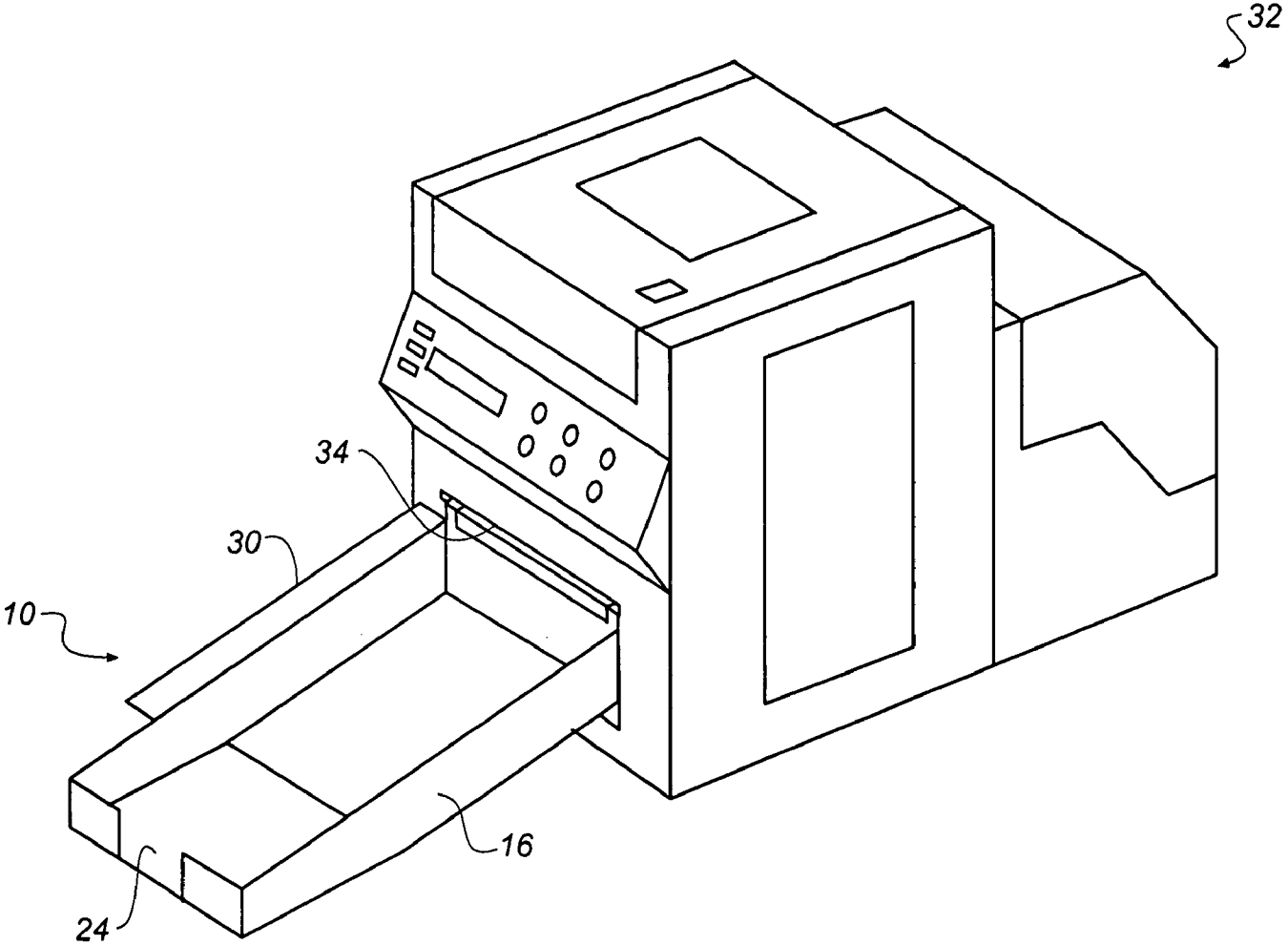
FIG. 2 shows a perspective view of the receiving tray of the present invention attached to a thermal printer.

Looking next at FIG. 2 there is shown a perspective view of the receiving tray 10 of the present invention attached to a thermal printer 32. Thermal printer 32 includes a print media exit slot 34. As depicted, support brackets 26 engage the printer at or proximate to the exit slot 34. The angle of descent of receiving tray 10 away from thermal printer 32 may be such that the base portion 24 of receiving tray 10 may be supported on the same surface that supports the thermal printer 32. Support brackets 26 are adapted to engage thermal printer 32 such that the print well 28 is laterally offset from the exit slot 34.

Figure 3:
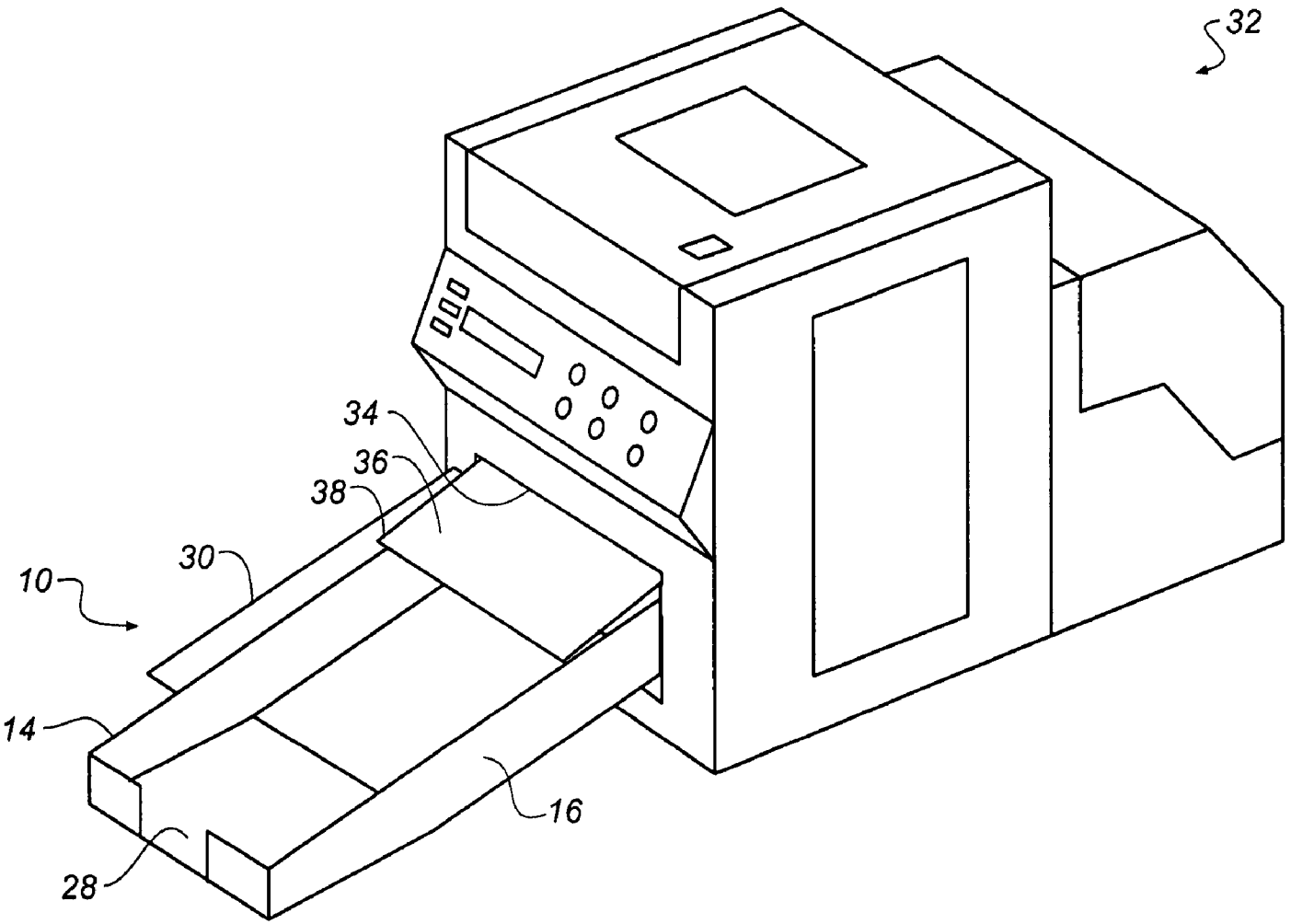
FIG. 3 shows a sheet of print media emerging from the exit slot of a thermal printer.

Looking next at FIGS. 3 through 8 there is shown in sequence the delivery of two successive prints into the receiving tray 10 of the present invention exiting from an exit slot 34 of thermal printer 32. In FIG. 3, a first sheet of print media 36 is emerging from exit slot 34. Note that because print well 28 of the receiving tray 10 is laterally offset from exit slot 34, an edge 38 of the first sheet of print media 36 overhangs first side wall 14 and preferably is partially supported on ledge member 30 as that first sheet of print media 36 exists exit slot 34.

Figure 4:
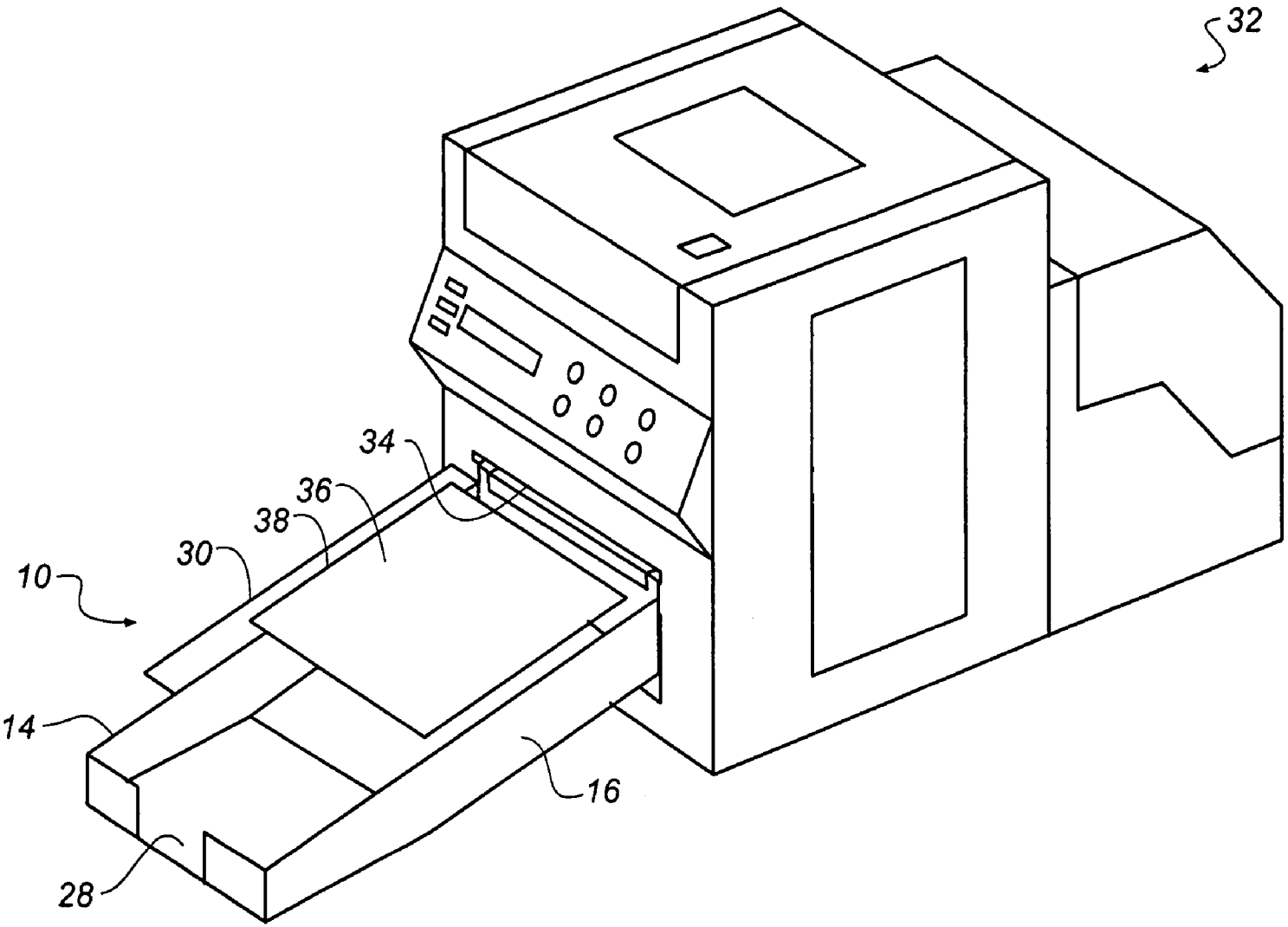
FIG. 4 shows a sheet of print media as it is released from the exit slot.
Figure 5:
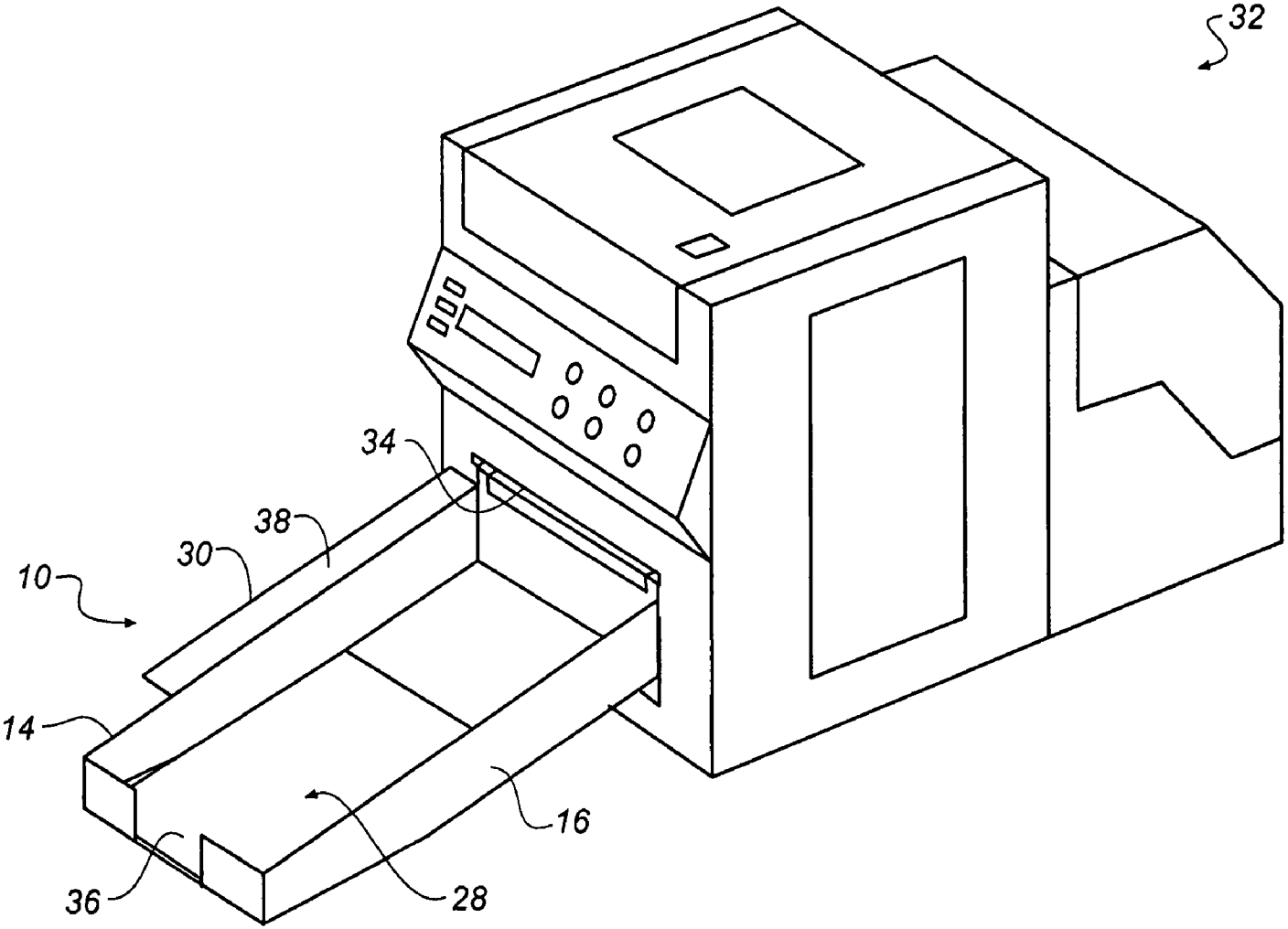
FIG. 5 shows a sheet of print media released into the print well of the receiving tray of the present invention.

Looking next at FIG. 4, the first sheet of print media 36 is shown just as it is released fully from exit slot 34. At the moment of release, the edge 38 of the first sheet of print media 36 still overhangs first side wall 14 and the edge 38 is preferably in contact with ledge member 30. As the first sheet of print media falls with a vertical component toward print well 28, a lateral component of movement is added to the first sheet of print media 36 because the first sheet of print media 36 will tend to fall off the top portion of the first side wall 14 and into the print well 28. This lateral component of the movement of the first sheet of print media is enhanced by the bias provided by the slope of ledge member 30 which is preferably angled downwardly between the first and second sidewalls 14, 16. In this manner, the first sheet of print media 36 falls to the bottom of the print well 28 as shown in FIG. 5.

Figure 6:
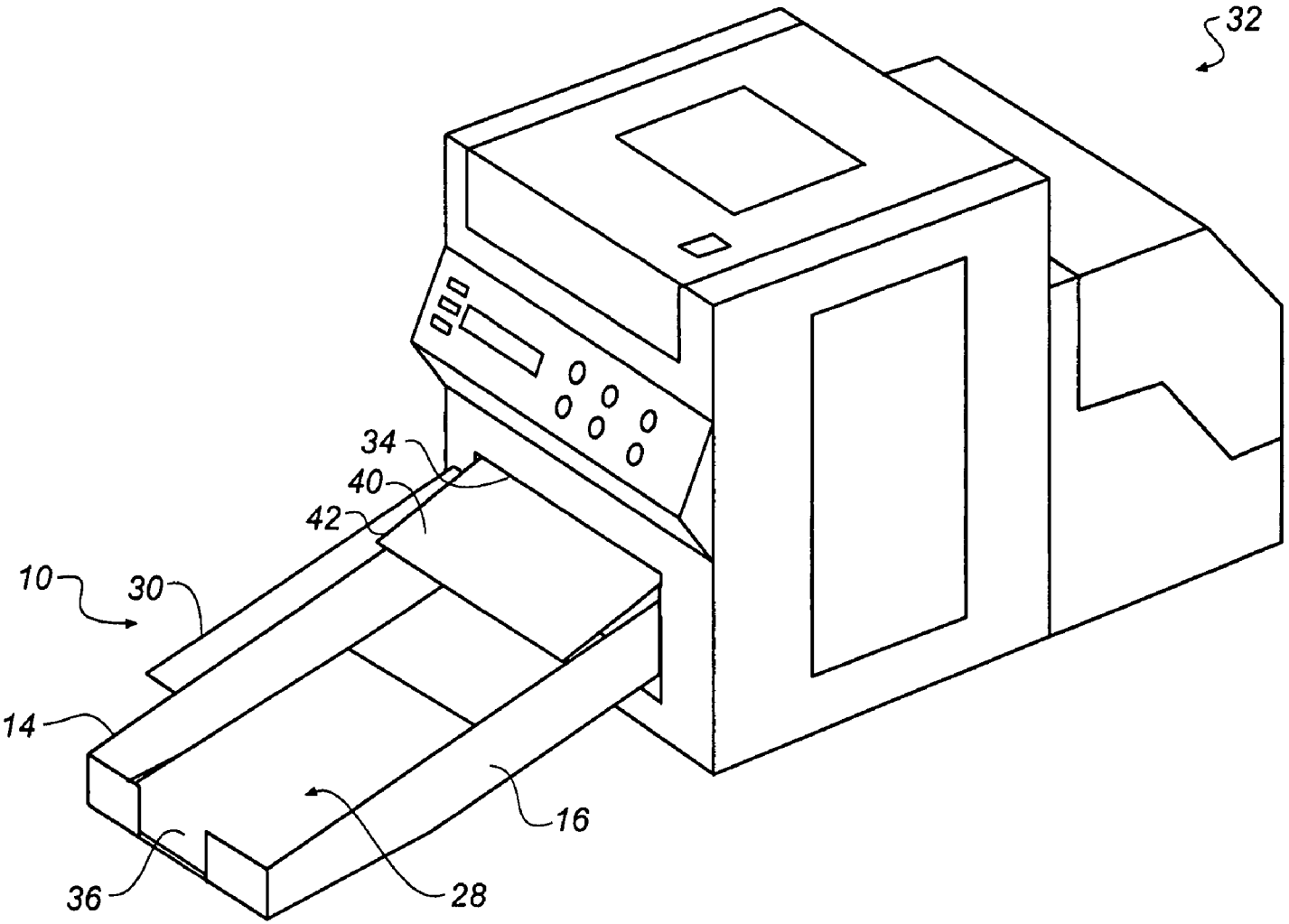
FIG. 6 shows a second sheet of print media emerging from the exit slot of a thermal printer.

Looking next at FIG. 6 there is shown a second sheet of print media 40 exiting exist slot 34 of printer 32 with the first sheet of print media 36 already residing in print well 28. As with the first sheet of print media 36, a side edge 42 of the second sheet of print media 40 overhangs the first side wall 14 such that the side edge 42 is supported on ledge 30.

Figure 7:
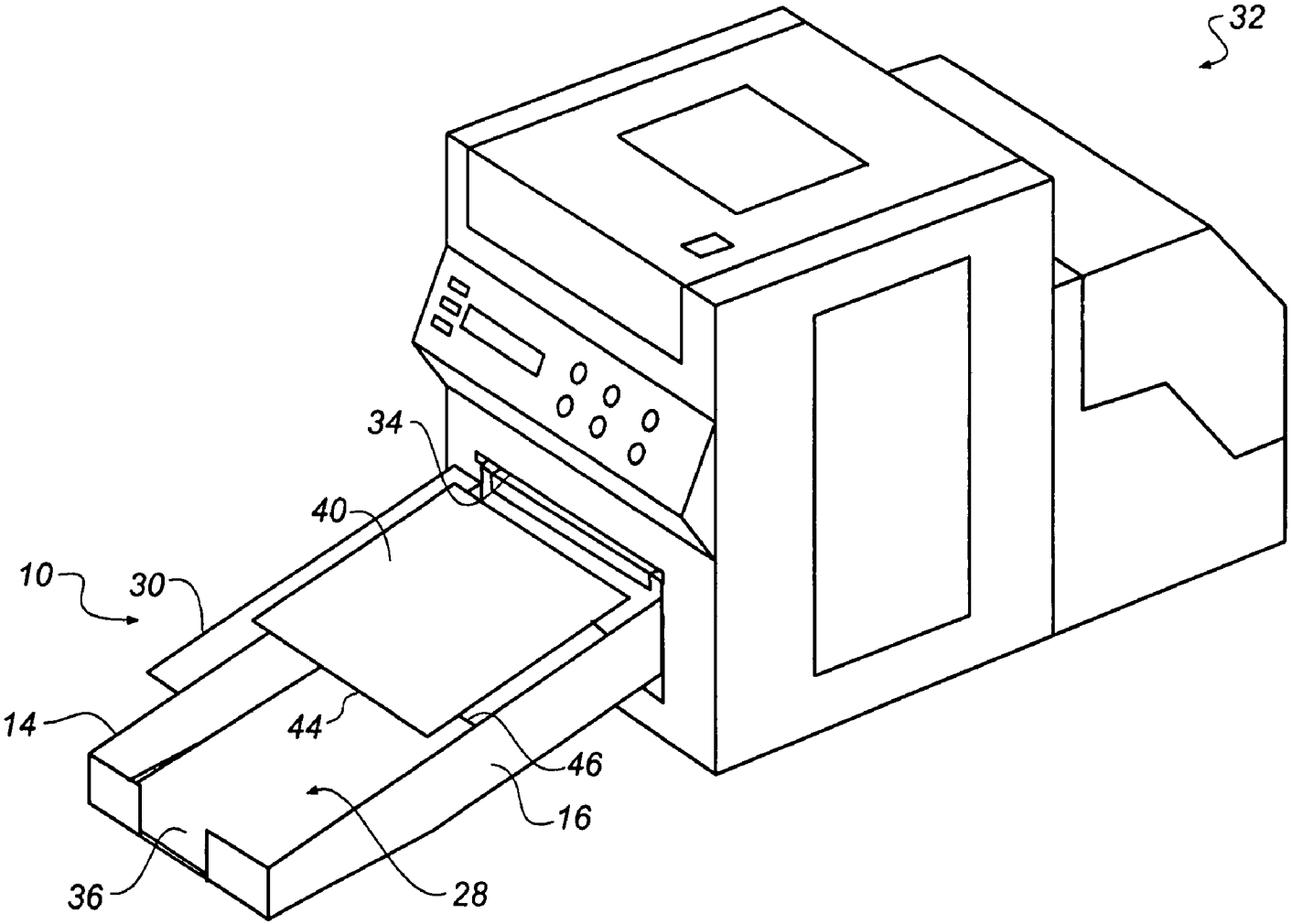
FIG. 7 shows a second sheet of print media being released from the exit slot into the print well of the receiving tray of the present invention.
Figure 8:
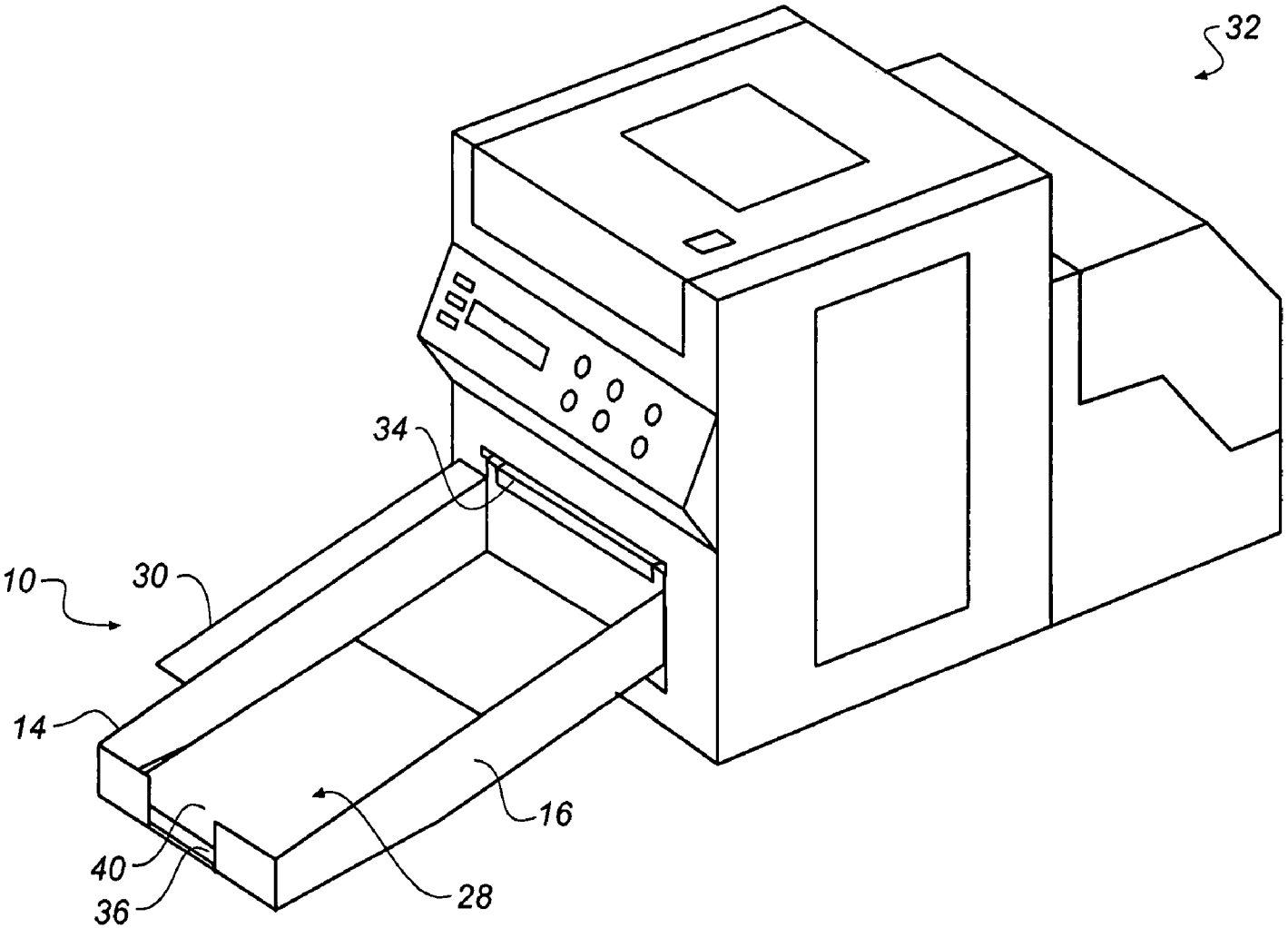
FIG. 8 shows a second sheet of print media resting on top of a first sheet of print media in the print well of the receiving tray of the present invention.

Looking next at FIG. 7, the second sheet of print media 40 has now been fully released from exit slot 34. As with the first sheet 36, the second sheet 40 falls with both vertical and lateral components into the print well 28. Because of the lateral offset of the print well 28 from the exit slot 34, and the partial support of the second sheet 40 on the top portion of the side wall 14 and ledge member 30, the potential for stubbing of the lead end 44 of the second sheet 40 into the trailing end 46 of the first sheet 36 is obviated. As such, the second print 40 falls into print well 28 as shown in FIG. 8 to rest on top of the first sheet 36.

Figure 9:
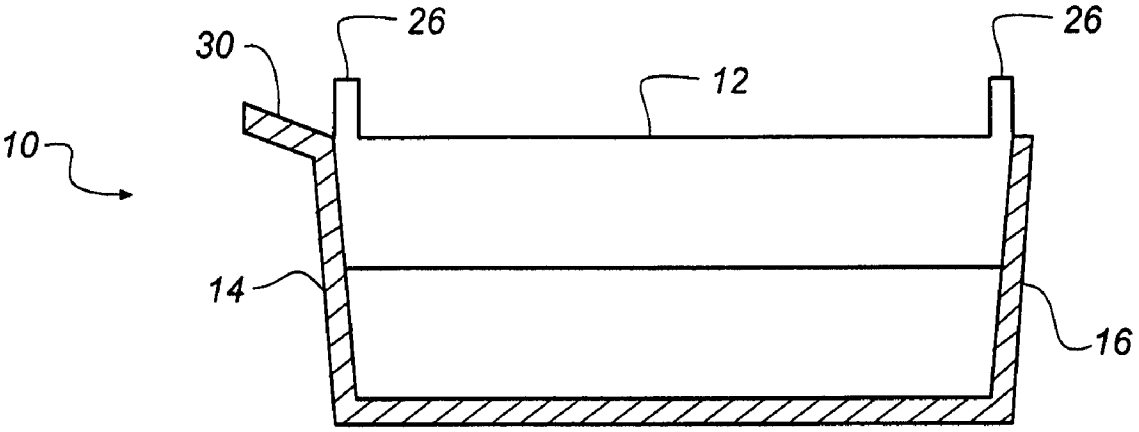
FIG. 9 shows a cross-sectional view taken along line 9-9 of FIG. 1 showing the slope of the ledge member.

Looking next at FIG. 9 there is shown a cross-sectional view taken along line 9-9 of FIG. 1. From this view, the slope of ledge member 30 can clearly be seen. This slope acts as a biasing means for urging print media having an edge thereof supported thereon to fall into the receiving tray 10.

Figure 10:
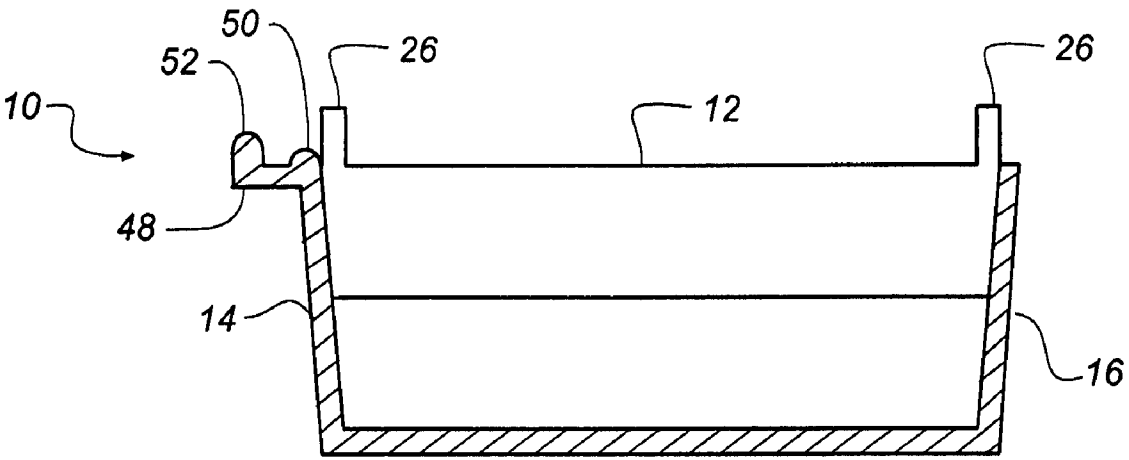
FIG. 10 shows a cross sectional alternative configuration from that depicted in FIG. 9 showing a ledge member having a first and second rail projecting upward therefrom.
Figure 11:
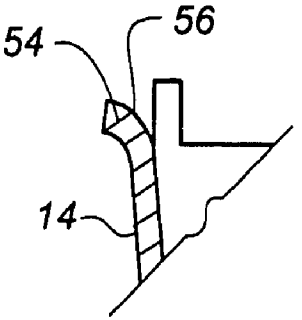
FIG. 11 shows another alternative configuration of the top portion of the first side wall from those depicted in FIGS. 9 and 10.
Figure 12:
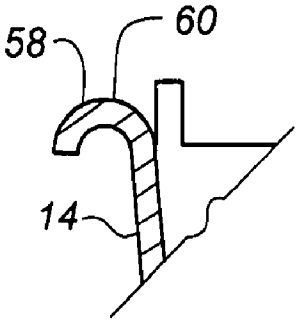
FIG. 12 shows yet another alternative configuration of the ledge member extending from the first side wall.
Figure 13:
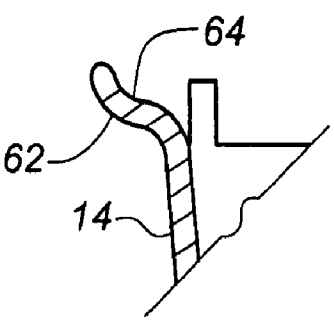
FIG. 13 shows still another alternative configuration of the ledge member projecting outward from the side wall from those depicted in FIGS. 9-12.

Looking at FIG. 10 there is shown in cross section an alternative configuration of the upper portion of first side wall 14 from what is shown in FIG. 9. In this alternative configuration, there is a ledge member 48 having a first rail 50 and a second rail 52 projecting upwardly therefrom. Preferably, second rail 52 projects higher than first rail 50. In such manner, a sheet of print media resting partially thereon would again be biased to fall into the receiving tray 10. Still other configurations of the top portion of first side wall 14 are shown in FIGS. 11, 12, and 13. In FIG. 11, the top portion 54 may be characterized as a quarter round and includes a top surface 56 which is convex. In FIG. 12 there is a ledge member 58 extending from first side wall 14 presenting a semi-cylindrical surface 60 for supporting sheets of print media. In FIG. 13, there is shown a ledge member 62 projecting outwardly from side wall 14 having a support surface 64 which is generally concave in configuration. The convex surfaces shown in FIGS. 11 and 12 and the concave surface 64 shown in FIG. 13 all tend to bias the sheet of print partially supported thereon into the receiving tray 10.

Figure 14:
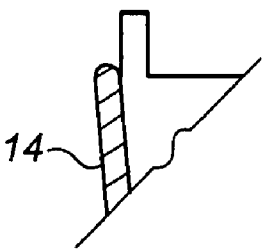
FIG. 14 shows yet another alternative to the top portion of the side wall with no projecting ledge member from those depicted in FIGS. 9-13.

Finally, in FIG. 14 there is shown yet another alternative to the top portion of side wall 14. As depicted in FIG. 14, side wall 14 includes no projecting ledge member. With this configuration reliance is primarily on the weight of the sheet with much more of the sheet overhanging into the tray than over the side wall 14 and outside of the tray to cause the sheet to fall laterally into the offset print well.

Figure 15:
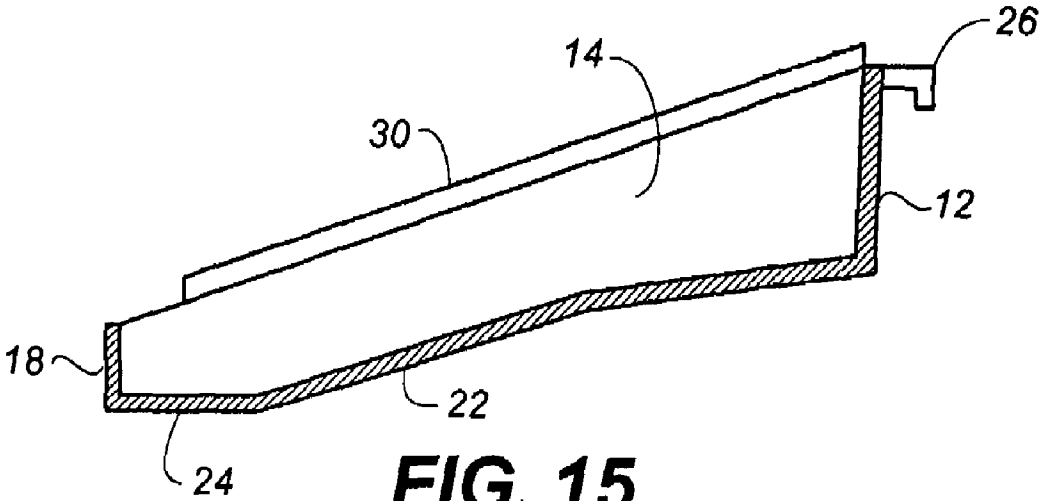
FIG. 15 is a cross-sectional view of the receiving tray of the present invention taken along line 15-15 of FIG. 1 showing support brackets hooked into a thermal printer.
Figure 16:
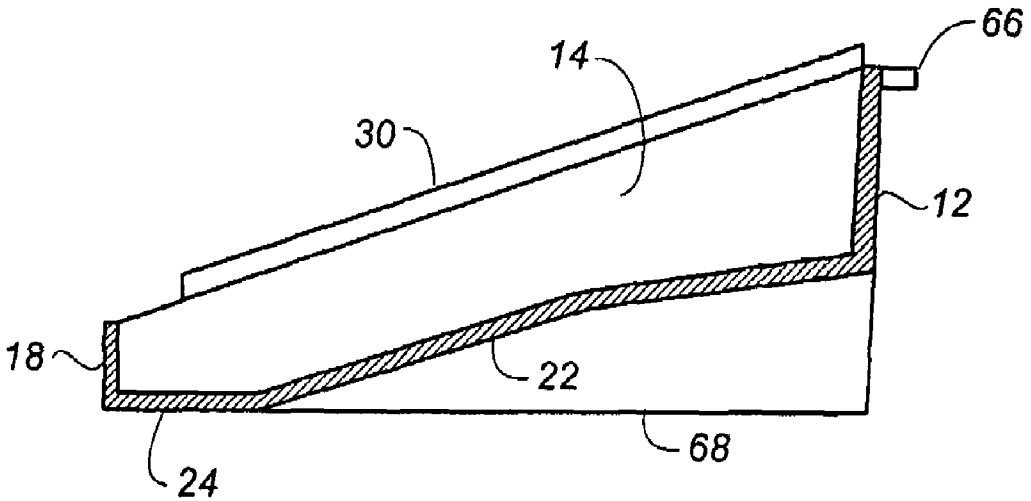
FIG. 16 is an alternative cross section of the receiving tray shown in FIG. 15 showing positioning members projecting from the rear wall of the receiving tray.

Looking next at FIG. 15, there is shown a cross-sectional view of the receiving tray 10 taken along the line of 15-15 of FIG. 1. From this view, it can clearly be seen that with support brackets 26 hooked into a thermal printer, the receiving tray 10 can be supported both by the support brackets 26 and a surface beneath base portion 24. An alternative cross section is depicted in FIG. 16 from that shown in FIG. 15. Instead of support brackets 26, there are positioning members 66 projecting from rear wall 12. Positioning members 66 are adapted to interface with receiving orifices in a thermal printer to accurately position the receiving tray 10 such that it is laterally offset from the exit slot of the thermal printer. In this configuration it is desirable to provide additional support to the receiving tray 10. One way of doing this would be to extend the side walls 14, 16, past ramp 22 such that the bottom 68 of side walls 14, 16 are co-planar with base portion 24. It will be apparent to those skilled n the art that a variety of leg configurations may be sued in place of the extended side walls shown in FIG. 16.

The invention has been described in detail with particular reference to certain preferred embodiments thereof, but it will be understood that variations and modifications can be effected within the spirit and scope of the invention.

PARTS LIST

10 receiving tray
12 rear wall
14 first side wall
16 second side wall
18 front wall
20 access opening
22 ramp portion
24 base portion
26 support brackets
28 print well
30 ledge member
32 thermal printer
34 exit slot
36 first sheet of print media
38 edge
40 second sheet of print media
42 side edge
44 lead edge

46 trailing end
48 ledge member
50 first rail
52 second rail
54 top portion
56 top surface
58 ledge member
60 semi-cylindrical surface
62 ledge member
64 support surface
66 positioning members
68 bottom

The invention claimed is:

1. A tray for receiving multiple sheets of printed media emerging from an exit slot of a printer, the tray comprising:

(a) a print well including a ramp, a first side wall, and a second side wall, the first side wall and the second side wall residing in opposing positions to one another and spaced apart from one another by at least a width of the sheets exiting the printer; and (b) at least one support member for connecting the tray to the printer and positioning the tray such that the print well is laterally offset from the exit slot causing each individual sheet of printed media exiting from the exit slot to overhang the first side wall and be partially supported on a top portion thereof until the individual sheet of media is released from the printer, said support member being adapted to cause the sheet to fall off of the top portion of the first side wall into the print well before a next sheet of printed media exits the exit slot;

wherein the at least one support member is a bracket adapted to be held in guide orifices in the printer.

2. A tray as recited in claim 1 wherein:

the ramp is angled downwardly away from exit slot.

3. A tray for receiving multiple sheets of printed media emerging from an exit slot of a printer, the tray comprising:

(a) a print well including a ramp and at least two side walls; and (b) at least one positioning member extending from the tray adapted to engage the printer and position the tray such that the print well is laterally offset from the exit slot causing each individual sheet of printed media exiting from the exit slot to overhang one of the two side walls and be partially supported on a top portion thereof until the individual sheet of media is released from the printer, said support member being adapted to cause the sheet to fall off of the top portion of the first side wall and into the print well before a next sheet of printed media exits the exit slot;

wherein the positioning members are cantilevered rods adapted to be inserted into guide orifices in the printer.

4. A tray as recited in claim 3 further comprising:

at least one support leg extending from the tray to support the tray adjacent to the printer.

5. A tray as recited in claim 3 further comprising:

a ledge member extending from a top portion of the first side wall, the ledge member configured to bias movement of the sheets of printed media exiting the printer and in contact with the ledge member to fall into the print well.

6. A tray as recited in claim 5 wherein:

the ledge member is sloped toward the print well.

7. A tray for receiving multiple sheets of printed media emerging from an exit slot of a printer, the tray comprising:

(a) a print well including a ramp, a first side wall, and a second side wall, the first side wall and the second side wall residing in opposing positions to one another and spaced apart from one another by at least a width of the sheets exiting the printer;

(b) at least one support member for connecting the tray to the printer and positioning the tray such that the print well is laterally offset from the exit slot causing each individual sheet of printed media exiting from the exit slot to overhang the first side wall and be partially supported on a top portion thereof until the individual sheet of media is released from the printer, said support member being adapted to cause the sheet to fall off of the top portion of the first side wall into the print well before a next sheet of printed media exits the exit slot; and (c) a ledge member extending from a top portion of the first side wall, the ledge member configured to bias movement of the sheets of printed media exiting the printer and in contact with the ledge member to fall into the print well;

wherein the ledge member includes a concave contact surface.

8. A tray as recited in claim 7 wherein:

the ledge member is sloped toward the print well.

9. A tray for receiving multiple sheets of printed media emerging from an exit slot of a printer, the tray comprising:

(a) a print well including a ramp, a first side wall, and a second side wall, the first side wall and the second side wall residing in opposing positions to one another and spaced apart from one another by at least a width of the sheets exiting the printer;

(b) at least one support member for connecting the tray to the printer and positioning the tray such that the print well is laterally offset from the exit slot causing each individual sheet of printed media exiting from the exit slot to overhang the first side wall and be partially supported on a top portion thereof until the individual sheet of media is released from the printer, said support member being adapted to cause the sheet to fall off of the top portion of the first side wall into the print well before a next sheet of printed media exits the exit slot; and (c) a ledge member extending from a top portion of the first side wall, the ledge member configured to bias movement of the sheets of printed media exiting the printer and in contact with the ledge member to fall into the print well;

wherein the ledge member includes a convex contact surface.

10. A tray for receiving multiple sheets of printed media emerging from an exit slot of a printer, the tray comprising:

(a) a print well including a ramp, a first side wall, and a second side wall, the first side wall and the second side wall residing in opposing positions to one another and spaced apart from one another by at least a width of the sheets exiting the printer;

(b) at least one support member for connecting the tray to the printer and positioning the tray such that the print well is laterally offset from the exit slot causing each individual sheet of printed media exiting from the exit slot to overhang the first side wall and be partially supported on a top portion thereof until the individual sheet of media is released from the printer, said support member being adapted to cause the sheet to fall off of the top portion of the first side wall into the print well before a next sheet of printed media exits the exit slot; and (c) a ledge member extending from a top portion of the first side wall, the ledge member configured to bias movement of the sheets of printed media exiting the printer and in contact with the ledge member to fall into the print well;

wherein the ledge member includes at least two contact features projecting upwardly therefrom.

11. A tray as recited in claim 10 wherein:

a first one of the at least two contact features projects further from the ledge member than a second one of the at least two contact features.

12. A tray as recited in claim 10 wherein:

the one of the at least two contact features furthest from the print well projects further from the ledge member than the one of the at least two contact features closest to the print well.

13. A tray for receiving multiple sheets of printed media emerging from an exit slot of a printer, the tray comprising:

(a) a print well including a ramp and at least two side walls;

(b) at least one positioning member extending from the tray adapted to engage the printer and position the tray such that the print well is laterally offset from the exit slot causing each individual sheet of printed media exiting from the exit slot to overhang one of the two side walls and be partially supported on a top portion thereof until the individual sheet of media is released from the printer, said support member being adapted to cause the sheet to fall off of the top portion of the first side wall and into the print well before a next sheet of printed media exits the exit slot; and (c) a ledge member extending from a top portion of the first side wall, the ledge member configured to bias movement of the sheets of printed media exiting the printer and in contact with the ledge member to fall into the print well;

wherein the ledge member includes a concave contact surface.

14. A tray for receiving multiple sheets of printed media emerging from an exit slot of a printer, the tray comprising:

(a) a print well including a ramp and at least two side walls;

(b) at least one positioning member extending from the tray adapted to engage the printer and position the tray such that the print well is laterally offset from the exit slot causing each individual sheet of printed media exiting from the exit slot to overhang one of the two side walls and be partially supported on a top portion thereof until the individual sheet of media is released from the printer, said support member being adapted to cause the sheet to fall off of the top portion of the first side wall and into the print well before a next sheet of printed media exits the exit slot; and (c) a ledge member extending from a top portion of the first side wall, the ledge member configured to bias movement of the sheets of printed media exiting the printer and in contact with the ledge member to fall into the print well;

wherein the ledge member includes a convex contact surface.

15. A tray for receiving multiple sheets of printed media emerging tram an exit slot of a printer, the tray comprising:

(a) a print well including a ramp and at least two side walls;

(b) at least one positioning member extending from the tray adapted to engage the printer and position the tray such that the print well is laterally offset from the exit slot causing each individual sheet of printed media exiting from the exit slot to overhang one of the two side walls and be partially supported on a top portion thereof until the individual sheet of media is released from the printer, said support member being adapted to cause the sheet to fall off of the top portion of the first side wall and into the print well before a next sheet of printed media exits the exit slot; and (c) a ledge member extending from a top portion of the first side wall, the ledge member configured to bias movement of the sheets of printed media exiting the printer and in contact with the ledge member to fall into the print well;

wherein the ledge member includes at least two contact features projecting upwardly therefrom.

16. A tray as recited in claim 15 wherein:

a first one of the at least two contact features projects further from the ledge member than a second one of the at least two contact features.

* * * * *

UNITED STATES PATENT AND TRADEMARK OFFICE

CERTIFICATE OF CORRECTION

PATENT NO. : 7,673,873 B2
APPLICATION NO. : 10/866932
DATED : March 9, 2010
INVENTOR(S) : Robert F. Mindler et al.

It is certified that error appears in the above-identified patent and that said Letters Patent is hereby corrected as shown below:

| Issued Patent | | Description of Error |
|---|---|---|
| **Column** | **Line** | |
| 8 | 17 | In Claim 15, delete "tram" and insert -- from --, therefor. |

Signed and Sealed this

Eighteenth Day of May, 2010

David J. Kappos

David J. Kappos
*Director of the United States Patent and Trademark Office*